US007347577B1

(12) United States Patent
Rapisarda

(10) Patent No.: US 7,347,577 B1
(45) Date of Patent: Mar. 25, 2008

(54) LIGHTED GARMENTS, FOOTWEAR, BACKPACKS, AND OTHER ACCESSORIES WITH IMPROVED SWITCH

(76) Inventor: Carmen Rapisarda, 21211 Wisteria St., Apple Valley, CA (US) 92308

( * ) Notice: Subject to any disclaimer, the term of this patent is extended or adjusted under 35 U.S.C. 154(b) by 147 days.

(21) Appl. No.: 10/766,709

(22) Filed: Jan. 27, 2004

(51) Int. Cl.
*F21V 21/08* (2006.01)

(52) U.S. Cl. ..... 362/103; 362/276; 362/802

(58) Field of Classification Search ..... 362/103, 362/200, 276, 295, 394, 802; 36/136, 137
See application file for complete search history.

(56) References Cited

U.S. PATENT DOCUMENTS

| | | | | |
|---|---|---|---|---|
| 2,758,195 | A * | 8/1956 | Ludwig | 362/227 |
| 3,793,515 | A * | 2/1974 | Park | 362/802 |
| 4,158,922 | A | 6/1979 | Dana, III | |
| 4,524,409 | A * | 6/1985 | Yakubek | 362/295 |
| 4,722,035 | A | 1/1988 | Rapisarda | |
| 4,848,009 | A | 7/1989 | Rodgers | |
| 5,285,586 | A | 2/1994 | Goldston et al. | |
| 5,381,615 | A | 1/1995 | MacMillan | |
| 5,408,764 | A | 4/1995 | Wut | |
| 5,477,435 | A | 12/1995 | Rapisarda et al. | |
| 5,482,493 | A | 1/1996 | Rapisarda | |
| 5,550,721 | A | 8/1996 | Rapisarda | |
| 5,692,324 | A | 12/1997 | Goldston et al. | |
| 5,704,706 | A | 1/1998 | Goldston et al. | |
| 5,932,975 | A | 8/1999 | Wut | |
| 6,017,128 | A | 1/2000 | Goldston et al. | |
| 6,238,056 | B1 | 5/2001 | Rapisarda | |
| RE37,220 | E | 6/2001 | Rapisarda et al. | |
| 6,354,712 | B1 * | 3/2002 | Anteby | 362/103 |
| 6,619,812 | B2 | 9/2003 | Rapisarda | |

* cited by examiner

*Primary Examiner*—Y. My Quach-Lee
(74) *Attorney, Agent, or Firm*—John E. Wagner

(57) ABSTRACT

A lighting system for clothing, footwear, backpacks, and other accessories incorporates a battery, a switch, a counter circuit, a flasher and lamps or LEDs driven by the flasher. An improved switch has a tubular housing of electrical insulating material, which may be, for example, round or square in cross section. A pair of electrical contact pins extend into the interior of the housing and are aligned longitudinally. The external ends of the contact pins are wired to the counter circuit and the battery. A free-floating contact bar of electrical conducting material normally resides on the bottom of the housing and, upon movement of the shoe or clothing, will bounce against the contact pins thus closing the switch and causing an input signal to the counter circuit and causing the lamps or LEDs to be illuminated momentarily. In a second embodiment, the contact pins extend through the bottom of the housing and the contact bar may rest against the contact pins. An electrical timer circuit responsive to closing of the switch limits the flashing of the LEDs to one sequence of flashes until further movement of the switch causes it to open and close again.

14 Claims, 3 Drawing Sheets

FIG. 1
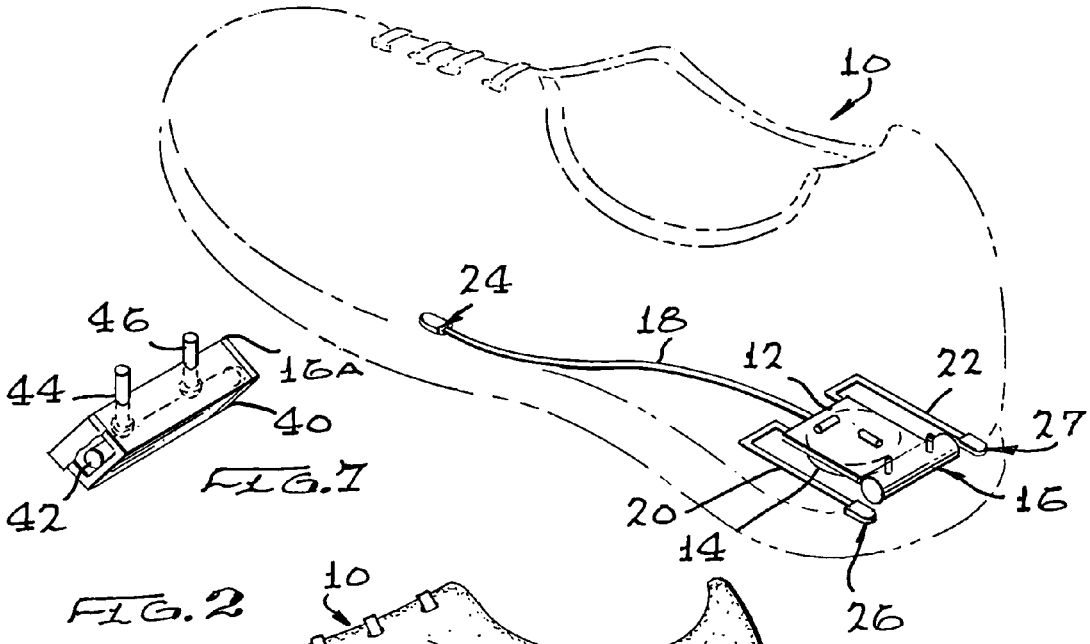
FIG. 7
FIG. 2
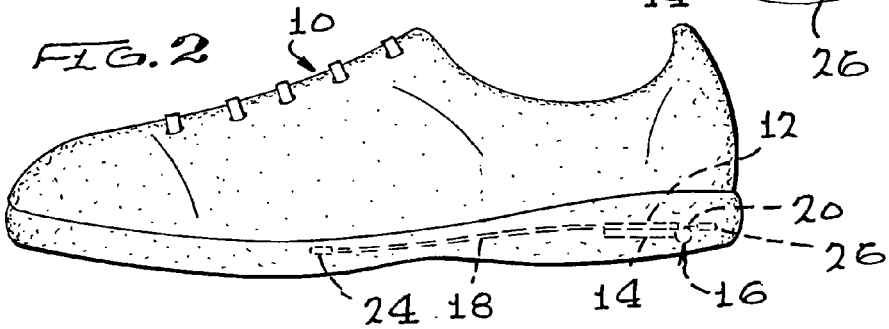
FIG. 3
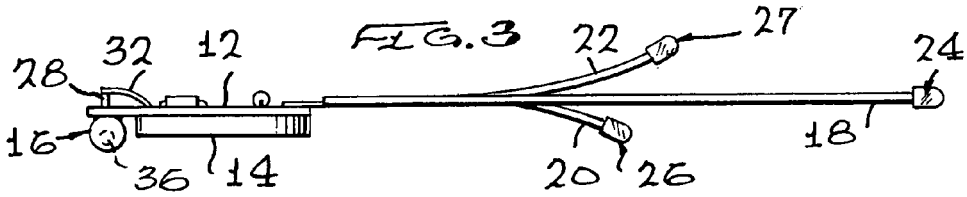
FIG. 4
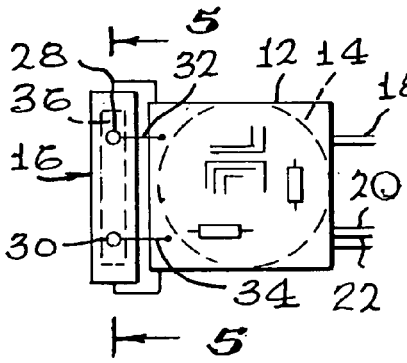
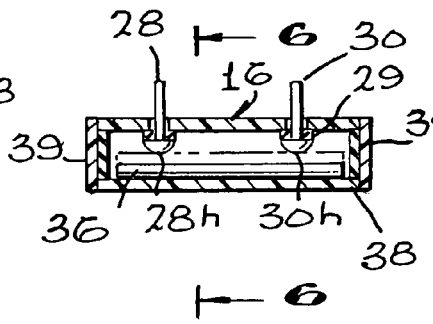
FIG. 5
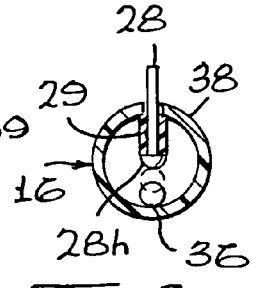
FIG. 6

FIG. 8
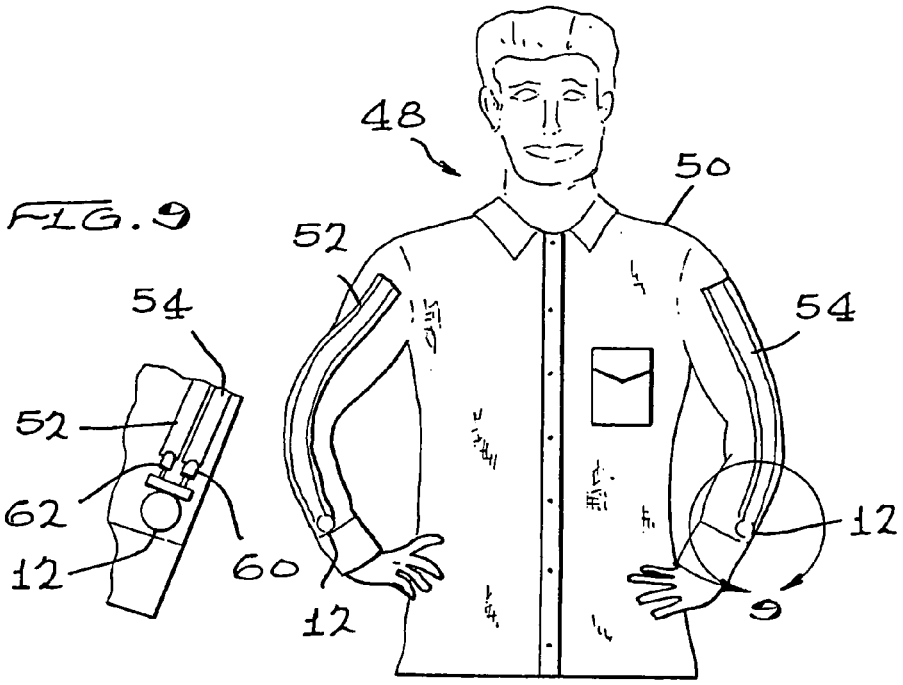
FIG. 9
FIG. 10
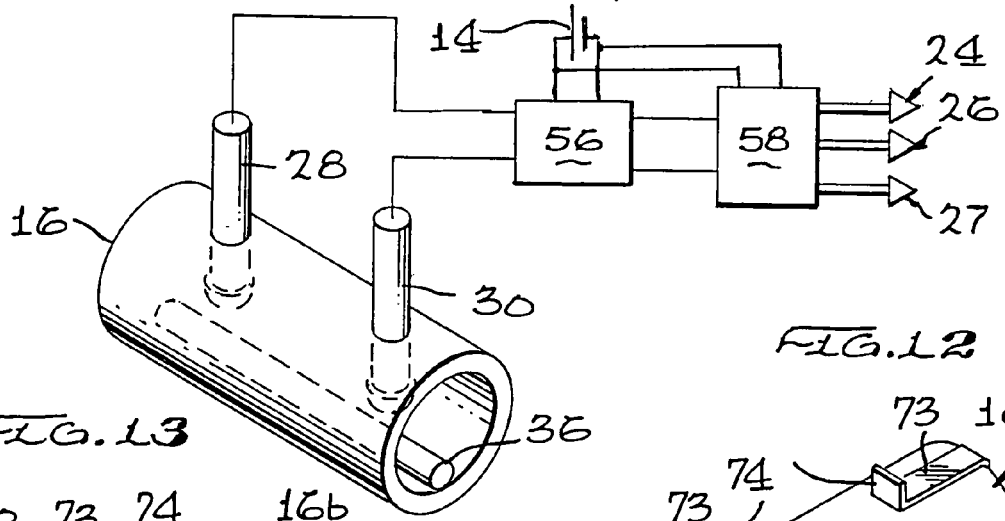
FIG. 12
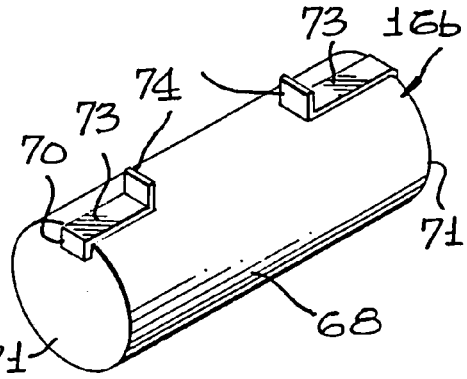
FIG. 13
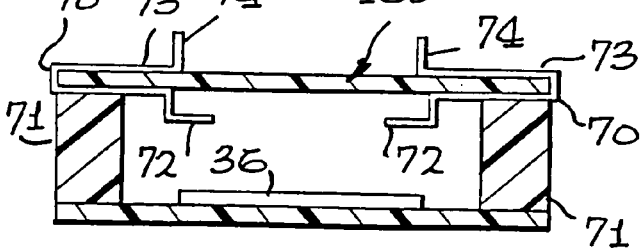

FIG. 11
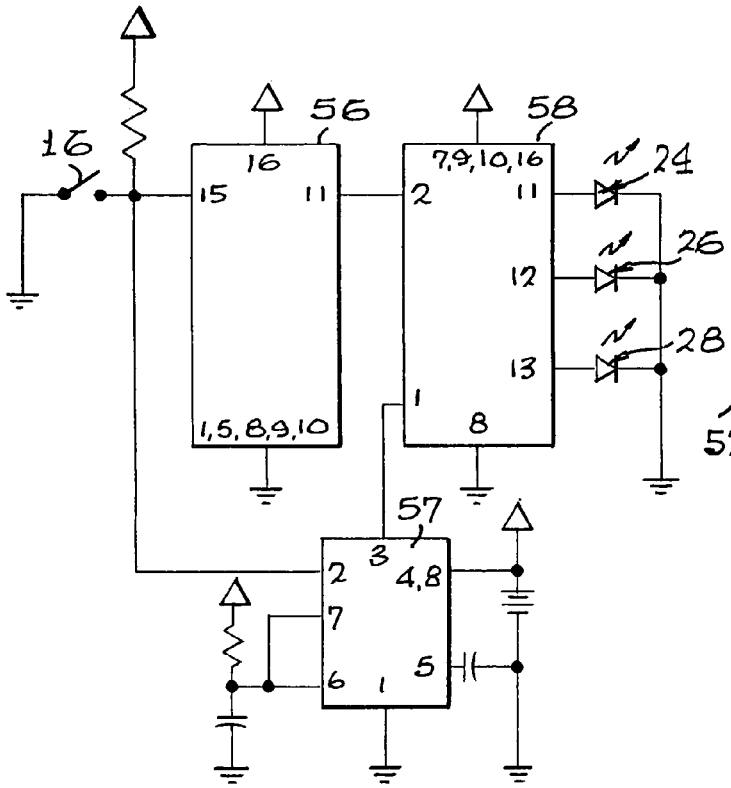
FIG. 17
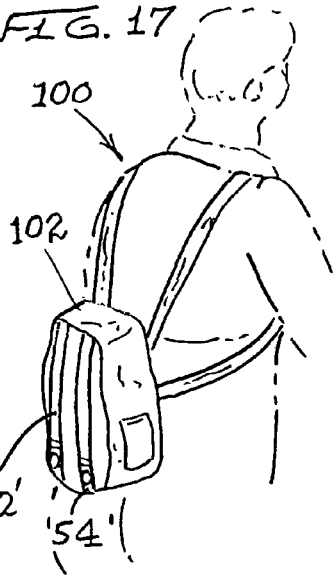
FIG. 15
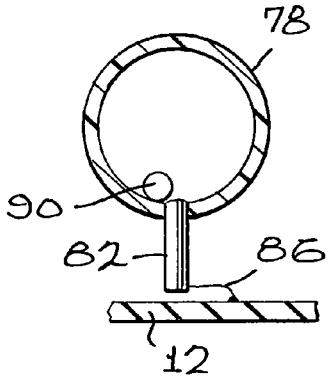
FIG. 14
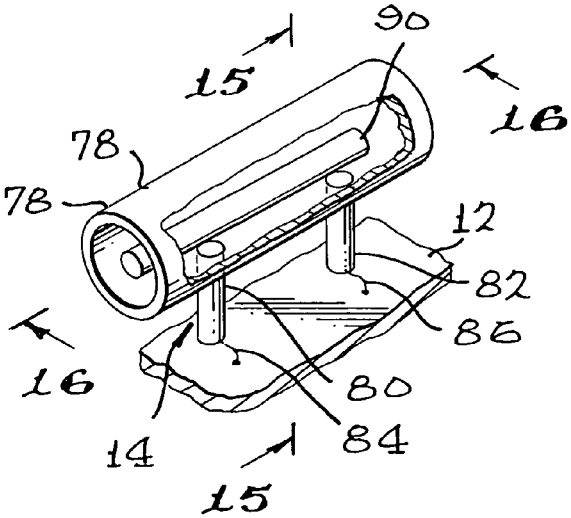
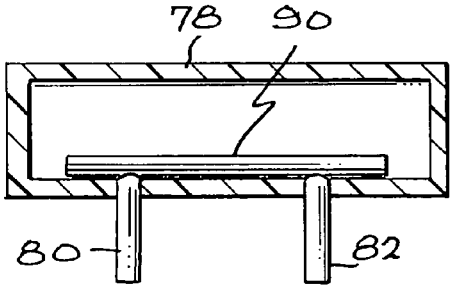
FIG. 16

LIGHTED GARMENTS, FOOTWEAR, BACKPACKS, AND OTHER ACCESSORIES WITH IMPROVED SWITCH

BACKGROUND OF THE INVENTION

The present invention relates to garments, footwear, backpacks, and other accessories worn with lighting elements. Garments and footwear with flashing lights have been popular for a number of reasons, including safety, an attractive appearance and simply for a novelty effect.

Lighting units for clothing and footwear have typically included a light source, such as one or more light-emitting diodes, a power source, such as a battery and a switch to cause the power source to be connected to the light or lights. Often such units will include electronic circuits which can control the time such lights are actually illuminated, which limits the power consumption, saving the battery. Short-term flashing often makes the display more visible, adding to the safety provided by the units. It also makes a more attractive eye-catching display.

A number of different types of lighting units or circuits have been described in the prior art. U.S. Pat. No. 4,158,922 to Dana III includes a mercury switch that responds to movements of the foot to turn a light on and off. A mercury switch operated system is also taught in U.S. Pat. No. 4,848,009 to Rogers.

Various arrangements have been developed for minimizing battery drain. Applicant's earlier U.S. Pat. No. 5,477,435 issued Dec. 19, 1995, now RE 37,220E, shows a light module with an LED having one terminal in contact with one side of a wafer battery, and the other terminal spaced away from the battery but including a weight which will cause the upper terminal to move by inertia in response to a shoe striking a surface to contact the battery to illuminate the LED. In this way, the LED is not illuminated and does not draw power from the battery when the module is at rest. Other modules for illuminating lights in footwear are shown in U.S. Pat. Nos. 5,408,764 and 5,932,975. U.S. Pat. No. 5,932,975 also includes microcircuits with a photosensitive switch to cause illumination to fade and then shut off entirely with full daylight. This is one of a number of battery-saving arrangements in the art.

One kind of switch in common usage is a spring switch which consists of an elongated coil of wire which has one end connected to one terminal in an electrical circuit and the opposite end cantilevered over a second terminal in the circuit. With the impact of the footwear against a surface or movement of body members carrying the switch, the spring will tend to bounce against the second terminal a number of times, thereby producing a series of positive or negative going electrical spikes or pulses.

Another type of switch which has been used in the above-described application is similar to a mercury switch but using a ball bearing which moves from an at-rest position where no contact is made with a second terminal to a position where the ball provides contact across two terminals, thereby closing a lighting circuit.

An objection which has been made to the systems described above is that once the illumination begins, it is quite regular and predictable during the period when illumination is taking place. It is believed that the desired effect would be considerably enhanced if the illumination were to be a more accurate light display of the shoe or garment movement rather than the distorted display produced by the spring-type switch trigger.

Mercury switches are currently considered unacceptable because of the toxic nature of mercury.

It is therefore an object of the present invention to provide a switch for use with lighting systems for footwear and other clothing which provides a more accurate display rather than the controlled output of switches presently in use.

Another factor that is of considerable importance in this application, especially with children's shoes, is cost. The switch constitutes a significant part of the cost of such lighting systems, and it would be very desirable to reduce such cost. It is, therefore, another object of the present invention to provide a switch suitable for use with shoes or clothing illumination systems which is significantly less expensive than those presently in use.

One further need is to provide a simple, low-cost switch that is not subject to inadvertent closed condition when the footwear or clothing happens to be in any random orientation as on a closet floor. This result has been achieved by employing switching logic in the module. This is the result of the use of a logic circuitry which responds to a switch closure to initiate one sequence of several pulses but will not continue sequencing until the switch opens and then recloses. This simplifies the switch design so that a closed contact condition only produces one sequence and then stops until the switch opens and recloses. No guards are required for preventing a closed switch condition to drain the battery.

BRIEF SUMMARY OF THE INVENTION

The switch which applicant has devised for use in lighting systems for wearing apparel, including shoes, jackets, backpacks, and the like, is small and incorporated into a very simplified electrical circuit which provides output signals to one or more light sources, such as lamps or LEDs. The switch itself includes a tubular housing of insulating material, such as glass, plastic or PVC (polyvinyl chloride) tubing. Preferred cross sections of the housing may be circular, triangular, or rectangular (square). Other cross-sectional shapes, such as oval, may be used. A pair of longitudinally spaced contact pins extend into the housing leaving terminals on the outside which are connected into the circuit and conductive points inside the housing.

A free-floating bar of conductive material is carried inside the housing, spaced from the contact pins. The length of the bar is sufficient to span the contact pins so that, upon movement of the switch, the bar will tend to instantaneously bridge the contact pins, thereby sending an input signal to the circuit and causing the LEDs or other light source to be illuminated. Unlike the spring switch described above, which inherently provides a series of input pulses for each movement of a shoe, for example, the switch described above only provides one input pulse per bridging contact between the contact pins. There may be several such bridging contacts, but these can be quite instant on and off in response to such movement.

Since there is a possibility that the shoe or other clothing could be tossed into a closet or other location into a position where the bar remains bridged across the contact pins, the contact pins may have insulated sidewalls so that contact of the bar with the contact pins is limited to desired areas of the pin surface.

This result can also be obtained by employing switching logic in the module. This is the result of the use of a logic circuitry which responds to a switch closure to initiate one sequence of several pulses but will not continue sequencing until the switch opens and then recloses. This simplifies the switch design so that a closed contact condition only produces one sequence and then stops until the switch opens and recloses. No insulation on the contact pins is required for preventing a closed switch condition from draining the battery.

To retain the free-floating bar, end members are either attached to the housing or formed in the housing. By using the free-floating bar, both the spring and spring mount are eliminated, which adds to reliability, while also reducing size and cost.

In addition to the above features, the size and weight of the free-floating bar and housing cavity can be modified to vary switching characteristics and sensitivity of the switch. The switch characteristics, particularly response time, may be modified by placing a non-conductive liquid in the housing.

BRIEF DESCRIPTION OF THE DRAWINGS

This invention may be more clearly understood with the following detailed description and by reference to the drawings in which:

FIG. 1 is a perspective view of a shoe, shown in phantom, with a lighting system including a switch according to the invention;

FIG. 2 is a side elevational view of the shoe of FIG. 1;

FIG. 3 is an enlarged side view of the lighting system shown in FIGS. 1 and 2;

FIG. 4 is a plan view, partly in phantom, of a substantial part of the lighting system of FIGS. 1-3;

FIG. 5 is a sectional view taken along line 5-5 of FIG. 4;

FIG. 6 is a sectional view taken along line 6-6 of FIG. 5;

FIG. 7 is a perspective view, with a portion broken away, of an alternative embodiment of the switch shown in FIGS. 4-6;

FIG. 8 is a front view of an individual wearing a shirt or jacket, including flexible lighting strips and employing the switch of this invention;

FIG. 9 is an enlarged fragmentary view of the encircled portion of FIG. 8 designated with numeral 9;

FIG. 10 is a schematic drawing of an electrical lighting circuit usable with the lighted shoe of FIGS. 1 and 2 or the flexible lighting strips of FIG. 8;

FIG. 11 is a more detailed schematic of the system of FIG. 10;

FIG. 12 is a perspective view of another embodiment of the switch of the invention;

FIG. 13 is a longitudinal sectional view of the switch of FIG. 12;

FIG. 14 is a perspective view of a still further embodiment of the switch of the invention;

FIG. 15 is a sectional view taken along line 15-15 of FIG. 14;

FIG. 16 is a sectional view taken along line 16-16 of FIG. 14; and

FIG. 17 is a rear view of an individual wearing a backpack including flexible lighting strips similar to those of FIG. 8 and employing the switch of the invention.

DETAILED DESCRIPTION OF THE PREFERRED EMBODIMENTS

Referring now to FIG. 1, a shoe 10 is shown having an electrical circuit board 12, including a battery 14 and a switch 16 embedded into its heel. Connected to the electrical circuit board 12 are pairs of wires 18, 20, and 22 terminating in light sources, such as LEDs 24, 26, and 27, respectively, which are located on or in the shoe 10 such that they are readily visible and will attract attention of those nearby.

FIG. 2 is a side elevational view of the shoe 10 of FIG. 1 showing the circuit board 12, the battery 14, switch 16, wires 18 to LED 24, and wires 20 to LED 26.

FIG. 3 is an enlarged side elevational view of the electrical circuit board 12, which is secured to the battery 14. Switch 16 of this invention is secured to the circuit board 12 and includes a contact bar 36, contact pins 28 and 30 secured to wires 32 and 34, respectively, connected to circuit board 12 (see FIG. 4). Only contact pin 28 and wire 32 are visible in this view. Also connected to circuit board 12 are wires 18, 20, and 22 connected to LEDs 24, 26, and 27, respectively.

FIG. 4 is a plan view of the circuit board 12 and switch 16. Since battery 14 is actually under circuit board 12, it is not visible in this view and is shown in phantom. Wires 18, 20, and 22 are shown in fragmentary form connected to circuit board 12. Contact pins 28 and 30 are shown connected to circuit board 12 by means of wires 32 and 34. Shown in phantom within switch 16 is contact bar 36, discussed below and better disclosed in FIGS. 5 and 6.

FIG. 5 is a sectional view taken along line 5-5 of FIG. 4. This view shows the structure of switch 16, including a housing 38, which may be of glass or other insulating material, such as plastic or PVC tubing. Embedded in the sidewall of housing 38 are contact pins 28 and 30, which are longitudinally aligned. Freely movable within housing 38 is a contact bar 36 of electrical conducting material which is of sufficient length to bridge contact pins 28 and 30, even if one end of contact bar 36 is against one of end walls 39 of housing 38. While end walls 39 are shown as separate plug members, any suitable closures for the ends of housing 38 can be used. With movement of switch 16, contact bar 36 will move to the position shown in dashed outline where it momentarily closes a connection between contact pins 28 and 30.

FIG. 6 is an enlarged sectional view taken along line 6-6 of FIG. 5. This view shows a hollow, cylindrical housing 38 with contact pin 28 through its sidewall and contact bar 36 resting on the bottom of the housing. A view of contact bar 36 in dashed outline depicts the alternate position of contact bar 36 contacting contact pins 28 and 30 following movement of switch 16. Pins 28 and 30 may each have an insulating coating on the pin portion or insulating collars 29 to prevent the contact bar 36 from lodging above the pin heads 28H and 30H.

FIG. 7 is a perspective view of an alternate embodiment 16*a* of the switch of FIGS. 1-6. In this embodiment, the housing 40 has a square cross section and is arranged in a diamond-like configuration with contact bar 42 sitting in a V-shaped groove at the bottom of the housing. A portion of the end of housing 40 is broken away to show contact bar 42 in housing 40. As in the case of switch 16, bar 42 will tend to move upwardly in case switch 16A is moved and make contact with contact pins 44 and 46. The tubular housing of switch 16 could be of other cross sections, such as oval, so long as the sidewalls do not interfere with movement of the contact bar toward and away from the contact pins.

FIG. 8 is a front view of an individual 48 wearing an article of wearing apparel, specifically a shirt or jacket 50 having light-transmitting strips 52 and 54, preferably of plasticized polyvinyl chloride (PVC), secured to its sleeves. Details of this garment and lighting strips are described in greater detail in U.S. Pat. No. 5,649,755 of this inventor. Light-transmitting strips 52 and 54 are illuminated by lamps or LEDs connected to a circuit board 12 or a similar board, including a switch 16 or a switch 16A, as shown in FIGS.

1-6 and 7, respectively. Upon movement of the individual wearing the shirt of jacket 50, the contact bar 36 or 42 (FIG. 5 or FIG. 7) will close the circuit on circuit board 12 causing illumination of the lamps or LEDs 60 and 62 (FIG. 9), which causes light to travel through strips 52 and 54.

FIG. 9 is an enlarged view of the encircled portion 9 of FIG. 8. The sleeve of jacket 50 includes light-transmitting strips 52 and 54 ends of which are in close proximity to LEDs 60 and 62. LEDs 60 and 62 are connected to circuit board 12 such that movement of the individual 48, and particularly of his arms, will cause momentary closure of switch 16 resulting in illuminating of LEDs 60 and 62. This momentary illumination of the LEDs will cause light-transmitting strips 52 and 54 to be illuminated also. An identical arrangement will illuminate strips similar to strips 52 and 54 on the surface of a backpack. Articles of clothing referred to herein are deemed to include backpacks wherein such illumination will provide a particularly effective safety measure. Other such indirect lighting arrangements may include fiber optic strands which pick up light from LEDs and transmit it wherever desired.

FIG. 10 is a schematic drawing of the electrical system of FIGS. 1-4. Switch 16 is shown including contact pins 28 and 30 and contact bar 36. Contact pins 28 and 30 are connected through bar 36 whenever it bounces upward and makes contact with both such pins. A battery 14 is connected to a counter circuit 56, which could be a CD4516 cmos counter and which responds to a signal from switch 16 by sending an input signal to an LED flasher unit 58 which drives LEDs or lamps 24, 26, and 27. Battery 14 is also connected to flasher unit 58. Counter circuit 56 or an additional counter may include means responsive to initiation of a lighting signal for counting a given period and then disconnecting power to flasher unit 58. In this way, the battery 14 is protected from unwanted power drain in the event shoe 10 or jacket 50 happens to be left in a position in which contact bar 36 or 42 bridges contact pins 28 and 30 or contact pins 44 and 46.

FIG. 11 is a somewhat more detailed schematic drawing of the electrical system of FIG. 10. Output signal from switch 16 appears at terminal 15 of cmos counter 56 (CD4516) and also at terminal 2 of the timer 57 (7555). Counter 56 provides output pulses to an LED flasher unit 58 which drives lamps or LEDs 24, 26, and 27. The input signal from switch 16 causes timer 57 to begin counting for a given period after which it sends a reset pulse from its terminal 3 to input terminal 1 of flasher unit 58, which resets counter 56 to a zero output state, thereby causing the LEDs to stop flashing.

The preferred embodiment of the invention employs:

Cmos synchronous programmable 4-bit counter of Texas Instruments Type CD4516;

Cmos presettable up/down counter Type 74C160 of Texas Instruments;

National Semiconductor Timer Type LM555/LM555C timer;

Type T-1¾LEDs of Kingbright Electric Co.

3 V lithium battery, Type CR-2032.

It will be recognized that the described system may be varied in a number of ways. In particular, the number and arrangement of light sources on or around a shoe could involve either more or less than three light sources. All the light sources may be on the shoe or some may be elsewhere on the wearer's clothing.

This unit not only provides a selectable flashing rate by circuit component selection but also responds to a switch closure to provide one pulse sequence but does not run continuously. The switch must open and reclose to start each flashing sequence. This prevents battery drain if the switch remains closed indefinitely.

FIGS. 12 and 13 show another embodiment of my switch 16*b* in which the housing could be made of PVC material or other plastic. The switch 16*b* incorporates a cylindrical plastic housing 68 having metal contact members 70 formed around its ends. The housing 68 is closed at its ends with plugs 71. Contact members 70 include interior contacts 72, which interact with free moving bar 36 and exterior extensions 73 to contacts 74.

FIG. 14 is a perspective view of an alternate embodiment of the switch of FIGS. 1-6. In this embodiment, the housing 78 is generally cylindrical with contact pins 80 and 82 extending through the bottom of the sidewall of the housing. Contact pins 80 and 82 are connected to circuit board 12 by means of wires 84 and 86. Contact bar 90, which is of electrical conducting material, is freely movable within housing 78 and is of sufficient length to bridge contact pins 80 and 82. With movement, contact bar 90 will move to the position shown where it momentarily closes a connection between contact pins 80 and 82. This alternate embodiment is significantly more sensitive than that shown in FIGS. 1-6.

FIG. 15 is a sectional view taken along line 15-15 of FIG. 14. This view shows the housing 78 with one embedded contact pin 82 visible. Contact bar 90, which is of sufficient length to bridge the longitudinally aligned contact pins, is freely movable in housing 78. While at rest, contact bar 90 is closing the connection between the contact pins 80 and 82.

Because of the action of the counter circuit 56 discussed above in relation to FIGS. 10 and 11, an initial contact of bar 90 with pins 80 and 82 will start counter circuit 56 counting for a given time or number of cycles energizing LEDs 24, 26, and 27. After the given time or number of cycles has passed, counter circuit shuts off, the LEDs stop flashing, and there is no more drain on the battery.

FIG. 16 is a sectional view taken along line 16-16 of FIG. 14.

FIG. 17 is a rear view of an individual 100 carrying a backpack 102. Secured to backpack 102 are flexible lighting strips 52' and 54' which are, or may be, similar or identical to lighting strips 52 and 54 of FIG. 8. Lighting strips 52' and 54' are illuminated by lamps connected to a circuit such as that shown in FIGS. 1-6 and 7 and possibly including the circuit of FIG. 11 or a similar circuit. Movement of individual 100 results in closing the circuit on circuit board 12, causing illumination of lamps or LEDs 60 and 62 resulting in lighting strips 52' and 54'.

Advantages of the above switch are:

1. Provides momentary contact resulting in instant lighting effects rather than a set pattern of flashes.

2. Is more reliable than other switches used in systems for illuminating shoes, etc.

3. Lower in cost because of fewer parts, no springs, and no precision positioning of parts, or adjustment during manufacture.

4. In combination with the above-described electrical system, it avoids unintended battery drain by switch closures due to position of switch when the garment is not being worn.

The above-described embodiments of the present invention are merely descriptive of its principles and are not to be considered limiting. The scope of the present invention instead shall be determined from the scope of the following claims including their equivalents.

I claim:

1. For use in a lighting system for clothing having at least one light source providing illumination to be visible at an external surface of said clothing including:

a power source capable of supplying sufficient power to said light source to cause it to provide illumination;

an electrical circuit connected to said light source and said power source;

a switch connected to said power source responsive to movement of said switch comprising:

a housing having an elongated sidewall and means closing the ends of said housing;

a pair of electrical contact pins spaced from each other longitudinally along the sidewall of said housing extending into the interior of said housing; and an elongated member of electrical conducting material freely movable within said housing spaced from said contact pins and of length at least sufficient to span the distance between said contact pins whereby movement of said switch causes said member to bridge said contacts pins sending an electrical signal to said circuit and causing said light source to be illuminated.

2. A lighting system as claimed in claim 1 wherein said housing is angular in cross section.

3. A lighting system as claimed in claim 1 wherein said electrical circuit is connected to said switch and to said power source, said electrical circuit being responsive to initiation of each said electrical signal to limit the time duration of illumination of said light source.

4. A lighting system as claimed in claim 1 wherein said means includes end members and said conductive member is a bar of such length that said bar spans said contact pins even if one end of said bar contacts one of said end members.

5. A lighting system as claimed in claim 1 wherein said clothing constitutes shoes.

6. For use in a lighting system for clothing having at least one light source providing illumination to be visible at an external surface of said clothing comprising:

a power source capable of supplying sufficient power to said light source to cause it to provide illumination;

an electrical circuit connected to said light source and said power source;

a switch connected to said power source responsive to movement of said switch comprising;

a housing and means closing the ends of said housing;

a pair of electrical contact pins spaced from each other longitudinally along the sidewall of said housing extending into the interior of said housing, the sidewalls of said pins being insulated; and an elongated member of electrical conducting material freely movable within said housing spaced from said contact pins and of length at least sufficient to span the distance between said contact pins whereby movement of said switch causes said member to bridge said contacts sending an electrical signal to said circuit and causing said light source to be illuminated.

7. For use in a lighting system for clothing having at least one light source providing illumination to be visible at an external surface of said clothing, a power source capable of supplying sufficient power to said light source to cause it to provide illumination;

a switch connected to said power source responsive to movement of said switch comprising a tubular housing and end members closing the ends of said housing;

a pair of electrical contact pins extending into the interior of said housing and to the exterior of said housing, the sides of said pins being insulated; and a bar of electrical conducting material located within said housing spaced from said contact pins and of length at least sufficient to span the distance between said contact pins even if one end of said bar is in contact with one of said end members, whereby movement of said switch causes said bar to bridge said contact pins sending an electrical signal to said circuit and causing said light source to be illuminated.

8. A lighting system for shoes having at least one light source located to provide illumination visible on an external surface of said shoes including a source of electrical power connected to said light source at least sufficient to cause said light source to be illuminated;

a switch connected to said light source and to said power source comprising a tubular housing of electrical insulating material; and a pair of spaced electrical contacts extending from the interior to the exterior of said housing and a freely movable member of electrical conducting material located within said housing and of length at least sufficient to span the distance between the interior portions of said contacts to close said switch and to open said switch when said member is not in a position to make contact with both of said contacts, wherein said housing and said contacts are configured such that said member may rest against said contacts when said switch is at rest; and a circuit is connected between said power source and said light source for limiting the duration of the illumination of said light source following each closure of said switch.

9. In a lighting system for clothing having at least one light source located to provide illumination visible on an external surface of said clothing including a source of electrical power connected to said light source at least sufficient to cause said light source to be illuminated;

a switch connected to said light source and to said power source comprising a housing of electrical insulating material;

a pair of spaced electrical contacts extending from the interior to the exterior of said housing and a freely movable member of electrical conducting material located within the housing such that said member may rest against said contacts when said switch is at rest and can move first away and then against said contacts to cause said light source to be illuminated; and a circuit connected between said power source and said light source for limiting the duration of the illumination of said light source following each closure of said switch.

10. In a lighting system for wearing apparel having at least one light source located to be visible on an external surface of said apparel, an electrical circuit connected to said light source and a power source connected to said electrical circuit capable of supplying sufficient power to illuminate said light source;

and a switch connected in said electrical circuit responsive to movement of said switch to produce an input signal to said electrical circuits said switch comprising;

an elongated, generally tubular housing of electrical insulating material, a pair of electrical contact pins extending through a sidewall and into an interior of said housing and spaced along a line parallel to an axis of said housing;

and a bar of electrical conducting material freely movable in said housing and of a length at least sufficient to span the distance between said contact pins such that movement of said switch causes said bar to move to bridge said contact pins and produce said input, wherein said electrical circuit is responsive to initiation of each said input signal to limit the time duration of illumination of said light source.

11. A lighting system as claimed in claim 10 wherein said tubular housing is generally cylindrical.

12. For use in a lighting system for clothing having at least one light source providing illumination to be visible at an external surface of said clothing including:

a power source capable of supplying sufficient power to said light source to cause it to provide illumination;

an electrical circuit connected to said light source and said power source;

a switch connected to said power source responsive to movement of said switch comprising:

a housing having an elongated sidewall and end members closing the ends of said housing:

a pair of electrical contacts including extensions extending around said end members spaced from said contacts and of a length at least sufficient to span the distance between said contacts whereby movement of said switch causes a member of electrically conducting material to bridge said contacts sending an electrical signal to said circuit and causing said light source to be illuminated.

13. For use in a lighting system for clothing having at least one light source providing illumination to be visible at an external surface of said clothing including:

a power source capable of supplying sufficient power to said light source to cause it to provide illumination;

an electrical circuit connected to said power source;

a switch connected to said power source responsive to movement of said switch comprising a tubular housing having an elongated sidewall and end members closing the ends of said housing; a pair of longitudinally spaced electrical contacts extending into the interior of said housing and to the exterior of said housing;

a bar of electrical conducting material located within said housing, spaced from said contacts and of length at least sufficient to span the distance between said contacts even if one end of said bar is in contact with one of said end members, whereby movement of said switch causes said bar to bridge said contacts sending an electrical signal to said circuit and causing said light source to be illuminated; and a timing circuit connected between said switch and said light source for limiting the time during which said light source is illuminated following a single closure of said switch.

14. For use in a lighting system for clothing having at least one light source providing illumination to be visible at an external surface of said clothing including:

a power source capable of supplying sufficient power to said light source to cause it to provide illumination;

an electrical circuit connected to said light source and said power source;

a switch connected to said power source responsive to movement of said switch comprising:

a closed housing and a pair of electrical contacts spaced from each other along a wall of said housing and extending into the interior of said housing; and, a member of electrical conducting material freely movable within said housing spaced from said contacts and dimensioned to at least span the distance between said contacts whereby movement of said switch causes said member to bridge said contacts, sending an electrical signal to said circuit and causing said light source to be illuminated;

wherein said electrical circuit is connected to said switch and to said power source, said electrical circuit being responsive to initiation of each said electrical signal to limit the time duration of illumination of said light source.

* * * * *